US005208606A

United States Patent [19]

Klein et al.

[11] Patent Number: 5,208,606

[45] Date of Patent: May 4, 1993

[54] DIRECTIONALITY OF THERMAL INK JET TRANSDUCERS BY FRONT FACE METALIZATION

[75] Inventors: Igal E. Klein, Karmiel, Israel; Cathie J. Burke, Rochester, N.Y.; William G. Hawkins, Webster, N.Y.; Roberto E. Proano, Rochester, N.Y.

[73] Assignee: Xerox Corporation, Stamford, Conn.

[21] Appl. No.: 795,596

[22] Filed: Nov. 21, 1991

[51] Int. Cl.[5] ..... B41J 2/05; B41J 2/14

[52] U.S. Cl. ..... 346/1.1; 346/140 R

[58] Field of Search ..... 346/1.1, 140 R, 75; 239/DIG. 19; 205/67-69, 75, 118, 122, 127

[56] References Cited

U.S. PATENT DOCUMENTS

| | | | |
|---|---|---|---|
| 4,392,907 | 7/1983 | Shirato et al. | 156/252 |
| 4,555,062 | 11/1985 | You | 239/690 |
| 4,583,690 | 4/1986 | You | 239/690 |
| 4,595,937 | 6/1986 | Conta et al. | 346/140 R |
| 4,623,906 | 11/1986 | Chandrashekhar et al. | 346/140 R |
| 4,675,083 | 6/1987 | Bearss et al. | 204/11 |
| 4,694,308 | 9/1987 | Chan et al. | 346/140 R |
| 4,703,332 | 10/1987 | Crotti et al. | 346/140 R |
| 4,751,532 | 6/1988 | Fujimura et al. | 346/140 R |
| 4,773,971 | 9/1988 | Lam et al. | 204/11 |
| 4,791,436 | 12/1988 | Chan et al. | 346/140 R |
| 4,801,947 | 1/1989 | Lichtenberger et al. | 346/140 R X |
| 4,951,063 | 8/1990 | Hawkins et al. | 346/1.1 |

FOREIGN PATENT DOCUMENTS

| | | | |
|---|---|---|---|
| 0092229 | 10/1983 | European Pat. Off. | 346/75 |
| 0022068 | 2/1982 | Japan | 346/140 R |
| 0178065 | 9/1985 | Japan | 346/140 R |

*Primary Examiner*—Benjamin R. Fuller
*Assistant Examiner*—Alrick Bobb
*Attorney, Agent, or Firm*—Oliff & Berridge

[57] ABSTRACT

A thermal ink jet printhead has an outer, metallic hydrophobic coating on its front face to repel ink. Eliminating the accumulation of ink at the nozzles of the printhead allows an ink droplet to be accurately ejected and ensures the directionality of the ejected ink droplet onto the printing medium. The outer coating is formed of a metal selected from the group of noble metals, including gold, platinum, palladium, silver, rhodium and ruthenium. An adhesion layer is preferably deposited between the front face of the printhead and the outer ink-repellent coating. The metallic coating is preferably applied by electroplating, wet electroless plating, evaporation, sputtering, ion plating, CVD or plasma CVD.

24 Claims, 1 Drawing Sheet

DIRECTIONALITY OF THERMAL INK JET TRANSDUCERS BY FRONT FACE METALIZATION

BACKGROUND OF THE INVENTION

1. Field of the Invention

The present invention relates to an ink jet printhead, and, more particularly, to a printhead having an ink repellent coating adjacent the nozzles thereof to avoid the formation of puddles at the nozzles and ensure the directionality of the ink droplets ejected therefrom.

2. Description of Related Art

In ink jet printing, a printhead is usually provided having one or more ink-filled channels communicating with an ink supply chamber at one end and having an opening at the opposite end, referred to as a nozzle. These printheads form images on a recording medium, such as paper, by expelling or ejecting droplets of ink from the nozzles onto the recording medium. The ink forms a meniscus at each nozzle prior to being expelled in the form of a droplet. After a droplet is expelled, additional ink surges to the nozzle to reform the meniscus. An important property of a high quality printhead is precise jet directionality. This ensures that ink droplets will be placed precisely where desired on the printed document. Poor jet directional accuracy results in the generation of deformed characters and visually objectionable banding in half tone pictorial images.

A major source of ink jet misdirection is associated with improper wetting of the front face of the printhead which contains the array of nozzles. One factor which adversely affects jet directional accuracy is the interaction of ink accumulated on the front face of the printhead with the ejected droplets. Ink may accumulate on the printhead face either from overflow during the refill surge of ink or from the spatter of small satellite droplets resulting from the process of expelling droplets from the printhead. When accumulated ink on the front face of the printhead makes contact with ink in the channel (and in particular with the ink meniscus at the nozzle orifice), the ink distorts which results in an imbalance of forces acting on the egressing droplet and in turn leads to jet misdirection. This wetting phenomenon becomes more troublesome after extensive use of the printhead as the face oxidizes or becomes covered with a dried ink film. As a result, a gradual deterioration of the generated image quality occurs. Thus, in order to retain good ink jet directionality, wetting of the front face of the printhead is preferably suppressed.

In thermal ink jet printing, a thermal energy generator, usually a solid state resistor, is located in the channels near the nozzles at a predetermined distance therefrom. The resistors are individually addressed with a current pulse to momentarily vaporize the ink and form a bubble which expels the ink droplet. As the bubble grows, the ink bulges from the nozzle and is contained by the surface tension of the ink as a meniscus. The rapidly expanding vapor bubble pushes the column of ink filling the channel towards the nozzle. At the end of the current pulse, the heater rapidly cools, and the vapor bubble begins to collapse. However, because of inertia, most of the column of ink that received an impulse from the exploding bubble continues its forward motion and is ejected from the nozzle as an ink drop. As the bubble begins to collapse, the ink still in the channel between the nozzle and bubble starts to move toward the collapsing bubble, causing a volumetric contraction of the ink at the nozzle and resulting in the separation of the bulging ink as a droplet. The acceleration of the ink out of the nozzle while the bubble is growing provides the momentum and velocity of the droplet in a substantially straight line direction toward a recording medium, such as paper. However, puddling of ink in contact with the nozzle orifice in the face of a thermal ink-jet printhead will cause deflection of the droplet and thus misdirection. Therefore, the wetting characteristics of the front face of the printhead are critical to accurate printing.

Ink jet printheads include an array of nozzles and may be formed of silicon wafers using orientation dependent etching (ODE) techniques. The use of silicon wafers is advantageous because ODE techniques can form structures, such as nozzles, on the wafers in a highly precise manner. Moreover, these structures can be fabricated efficiently at low cost. The resulting nozzles are generally triangular in cross-section. Thermal ink jet printheads made by the abovementioned ODE techniques are typically comprised of a channel plate which contains a plurality of nozzle-defining channels located on a lower surface thereof bonded to a heater plate having a plurality of resistive heater elements formed on an upper surface thereof and arranged so that a heater element is located in each channel. The upper surface of the heater plate may include an insulative layer which is patterned to form recesses exposing the individual heating elements. This insulative layer is referred to as a "pit layer" and is sandwiched between the channel plate and heater plate so that the nozzle-containing front face may have three layers; the channel plate, the pit layer and the heater plate.

The heater and channel plates are typically formed from silicon, while the pit layer, sandwiched between the heater and channel plates, is formed from a polymer, typically polyimide. Since the front face of the printhead includes these different materials, a coating material, such as water-repellent material, will not adhere equally well to these different materials, resulting in a coating which is not uniformly ink repellent. Thus, it is difficult to provide a surface coating which is uniformly ink repellent for ink jet printheads formed from multiple layers.

Additionally, these printers typically use an ink which contains a glycol and water. Glycols and other similar materials are referred to as humectants, which are substances which promote the retention of moisture. For a coating material to be effective for any length of time, it must both repel and be resistant to glycol-containing inks.

Further, it is difficult to apply a coating to the face of an ink jet nozzle. Many materials will not adhere sufficiently to the silicon wafer face. While it is desirable to suppress the wetting property of the nozzle jet surface, it may be undesirable to allow any coating material to enter the channel of the nozzle. If the walls of the channel become coated with ink-repellent material, proper refill of the channel may be inhibited. Refill of each channel depends on surface tension and must be completed in time for the subsequent volley of drops to be fired. If the refill process is not complete by the time the next drop is fired, the meniscus may not be flush with the outer edge of the nozzle orifice, resulting in misdirection. Further, an incompletely filled channel causes the ink drop size to vary, which also leads to print quality degradation.

In ink jet printers, which are not thermally controlled, conductive ink is directly heated by passing electrical energy through the channel of ink between two electrodes. For example, U.S. Pat. No. 4,595,937 to Conta et al. discloses an ink jet printhead having a ceramic base with a conductive plate on the backside and a conductive plate on the front side which serve as an electrode and counter electrode, respectively. A nozzle is drilled through the ceramic layer between the conductive plates, and corrosion resistant layer covers the outer face of the printhead.

Similarly, U.S. Pat. No. 4,703,332 to Crotti et al. also utilizes an electrode and counter electrode located on the front face of the printhead. However, these ink jet printheads are distinct from thermal ink jet printheads which do not normally include a conductive layer on the outer face. For example, U.S. Pat. No. 4,751,532 to Fujimura et al. discloses a thermal electrostatic ink jet printhead having an insulating layer on its outer face. The insulating layer is critical to maintaining the shape of the meniscus at the nozzle orifice since the shape of the meniscus greatly influences printing quality. The insulating layer is made of a silicone type of fluorocarbon-type resin having a low surface energy treatment. However, such a low surface energy treatment requires a very complicated process as described in Fujimura et al.

Thus, the ability to change the wetting characteristics of the front face of the printhead to simply and effectively ensure directionality of an ink droplet is needed.

SUMMARY AND OBJECTS OF THE INVENTION

Accordingly, an object of the present invention is to provide a thermal ink jet printhead which ensures the directionality of the ejected ink droplets.

Another object of the present invention is to provide a printhead having a front face with low wettability.

A further object of the present invention is provide a printhead having a front face which is corrosion resistant.

An additional object of the present invention is to prevent ink collection at the nozzles in the face of a printhead.

These and other objects of the invention are achieved by providing a thermal ink jet printhead having a first substrate defining a channel plate with a front face and a second substrate defining an actuator plate with a front face. The first and second substrates are disposed in a facing relationship defining ink channels therebetween and nozzles in the front faces thereof. An outer, metallic, ink repellent laher is coated on the front faces adjacent the nozzles to avoid the formation of puddles of ink by changing the wetting characteristics of the front face of the printhead. The outer, metallic, ink repellent layer comprises a metal selected from the group of noble metals, which exhibit the properties of low wettability by the ink, low level of oxidation in air or in water and good adhesion to the substrate. Preferably, an adhesion layer is deposited between the front face of the printhead and the noble metal layer.

A process for ensuring directionality of ink droplets ejected from an ink jet printhead includes forming the ink jet printhead by coupling a first substrate, having channels therein and a front face, to a second substrate, having a front face, and coating the front faces of the substrates with a metallic, ink repellent layer. The metallic coating may be applied by electroplating, wet electroless plating, evaporation, sputtering, ion plating, chemical vapor deposition or plasma chemical vapor deposition. Intermediate layers including an adhesion layer may be deposited between the substrate front face and the metallic layer.

BRIEF DESCRIPTION OF THE DRAWINGS

The invention will be described in detail with reference to the following drawings in which like reference numerals refer to like elements.

DESCRIPTION OF THE PREFERRED EMBODIMENTS

The terms used herein, such as upper, lower, side and front, are for descriptive purposes only and are not intended to have a limiting effect.

Figure 1:
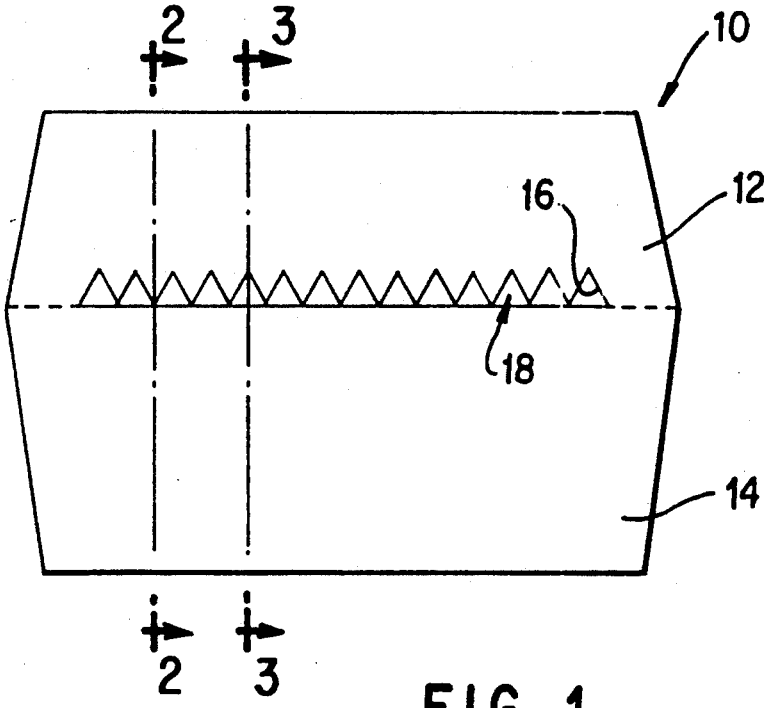
FIG. 1 is a front view of a printhead in accordance with the present invention.

Referring to the drawings, FIG. 1 shows a printhead 10 in accordance with the present invention. Printhead 10 includes a first or upper substrate 12 and a second or lower substrate 14. The substrates are formed of dielectric or semiconductor material, such as silicon, GaAs (gallium arsenide), glass, sapphire, alumina, AlN (aluminum nitride) or BeO (beryllium oxide). The semiconductor substrates may be doped.

Upper substrate 12 is a channel plate having elongated V-shaped channels 16 formed in the bottom surface thereof by ODE techniques for example. Lower substrate 14 is an actuator plate having a plurality of resistive heater elements (not shown) formed in the upper surface thereof. The heater elements of actuator plate 14 correspond in number and position to the channels 16 in channel plate 12.

Channel plate 12 and actuator plate 14 are coupled together, by bonding for example, such that the resistive heater elements face the channels 16. Channels 16 define ink channels which communicate with an ink manifold (not shown). Once the channel plate and actuator plate are coupled together, a dicing action is performed to achieve coplanarity along the front face of the printhead 10 to produce nozzles 18.

Figure 2:
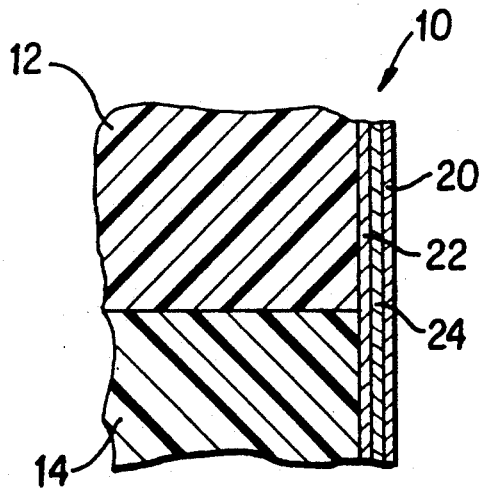
FIG. 2 is a cross-sectional view of the printhead of FIG. 1 taken along line 2—2.
Figure 3:
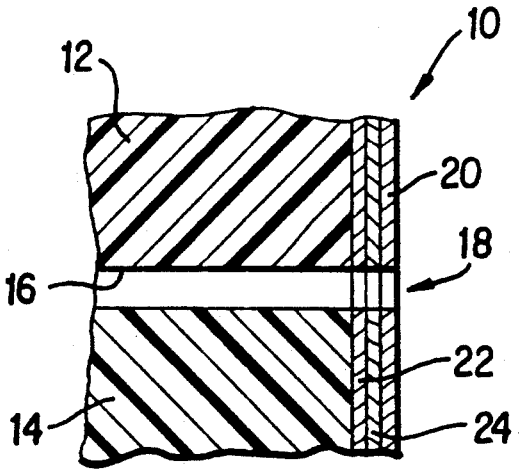
FIG. 3 is a cross-sectional view of a printhead of FIG. 1 taken along line 3—3.

To avoid puddling of ink on the front face of the printhead adjacent the nozzles 18, a metallic, ink repellent, hydrophobic layer 20 is applied to the printhead as shown in FIGS. 2 and 3. This outer ink repellent layer 20 changes the wetting characteristics of the front face of the printhead to prevent ink from collecting near the nozzles and interfering with the ejected ink droplets.

The metallic coating 20 is preferably chosen from the group of noble metals which includes gold, platinum, palladium, silver, rhodium and ruthenium, alloys or solid solutions of a noble metal with other noble metal and/or with nickel and/or cobalt, possibly doped by minor elements at levels below 2%. The metallic coating should show low wettability by the ink, have a low level of oxidation in air or in water (a rate of oxidation below 1 micron per year) and exhibit good adhesion to the substrate, which in the preferred embodiment is a dielectric or semiconductor substrate. The coating as shown in FIGS. 2 and 3 is shown exaggerated in thickness for illustrative purposes, but in application has a thickness in the range of about 0.5 to 12 micrometers, preferably about 3 to 6 micrometers.

An adhesion layer 22 is preferably deposited underneath outer metallic coating 20 on the front faces of substrates 12 and 14 as shown in FIGS. 2 and 3. Adhesion layer 22 may be formed of chromium, nickel, titanium, tantalum, aluminum, tungsten, their alloys and/or their oxides and/or nitrides. However, other materials suitable for adhesion between an outer metallic layer and an underlying dielectric or semiconductor substrate would be suitable.

One or more intermediate layers 24 may be deposited between the adhesion layer 22 and metallic layer 20 if needed for further adhesion, corrosion resistance, or stability. The intermediate layers may be formed of titanium tungsten, nickel, palladium or titanium. A further conductive layer such as nickel, copper or gold, also may be applied if the outer metallic coating 20 is deposited by electroplating.

Outer metallic coating 20 may be applied by electroplating, wet electroless plating, evaporation, sputtering, ion plating, CVD (chemical vapor deposition), plasma CVD or their modifications such as bias and/or magnetron sputtering. The selected process should have high throwing power and yield excellent adhesion. As mentioned above, if outer coating 20 is applied by electroplating, it should be preceded by deposition of a conductive layer using one of the above described processes. Adhesion layer 22 is preferably deposited underneath metallic coating 20 by evaporation, sputtering, ion plating, CVD or plasma CVD.

The coating process is generally carried out after substrates 12 and 14 are coupled together and diced. However, it is feasible to carry out the coating process on the wafer level rather than the assembled or die level which is more economically advantageous. A process such as bias sputtering enables the coating to be applied to the wafers or plates before they are assembled and diced.

Once the printhead front face is coated with the outer metallic, hydrophobic layer 20, ink will not collect at the nozzles due to the low wettability of the outer surface. Thus, the outer coating eliminates a major source of misdirection of the ejected droplets from printhead 10 and ensures that the droplets will be accurately directed and placed on the printing medium, such as paper.

While the invention has been described with reference to a particular preferred embodiment, the invention is not limited to the specific examples above. For example, the adhesion layer, intermediate layers and conductive layer may be formed of any suitable material and applied by any suitable process. Also, the printhead is not limited to the type having a channel plate and actuator plate forming nozzles therein. The present invention may be used in any type of ink jet printhead in which droplet formation is controlled by a variety of means other than resistive, such as piezoelectric transducers. Other embodiments and modifications may be made without departing from the spirit and scope of the invention as defined in the appended claims.

What is claimed is:

1. A thermal ink jet printhead, comprising:

a first substrate defining a dielectric channel plate having a first front face;

a second substrate defining an actuator plate having a second front face, said first front face and said second front face defining a printhead front face, said first substrate and said second substrate disposed in a facing relationship defining ink channels therebetween and nozzles in said printhead front face;

an outer, metallic, ink repellant layer coated on said printhead front face adjacent said nozzles;

an adhesion layer on said printhead front face; and an intermediate layer between said adhesion layer and said outer layer.

2. A printhead according to claim 1, wherein said outer layer is hydrophobic.

3. A printhead according to claim 1, wherein said outer layer comprises a metal selected from the group of noble metals.

4. A printhead according to claim 1, wherein said outer layer comprises a metal selected from the group of gold, platinum, palladium, silver, rhodium and ruthenium.

5. A printhead according to claim 1, wherein said outer layer is about 0.5 to 12 micrometers thick.

6. A printhead according to claim 1, wherein said outer layer is about 3 to 6 micrometers thick.

7. A printhead according to claim 1, wherein said adhesion layer comprises an element selected from the group consisting of chromium, nickel, titanium, tantalum, aluminum, and tungsten.

8. A printhead according to claim 1, wherein said intermediate layer comprises an element selected from the group consisting of titanium tungsten, nickel, palladium or titanium.

9. A thermal ink jet printhead comprising:

a dielectric channel plate having a first front face;

an actuator plate coupled to said channel plate and having a second front face, said first front face and said second front face being co-extensive defining a printhead front face and having nozzles therein;

an adhesion layer deposited on said printhead front face;

an intermediate layer over said adhesion layer; and a noble metal coating on said printhead front face adjacent said nozzles over said intermediate layer.

10. A process for ensuring directionality of ink droplets ejected from an ink jet printhead, comprising the steps of:

forming the ink jet printhead by coupling a first substrate having channels therein and a first front face to a second substrate having a second front face, the first front face and the second front face being coextensive and defining a printhead front face having nozzles therein, said first substrate being dielectric;

depositing an adhesion layer on the printhead font face;

depositing an intermediate layer over said adhesion layer; and coating a metallic, ink repellant layer on the printhead front face around said nozzles.

11. A process according to claim 10, wherein said coating step comprises electroplating a metal selected from the group of noble metals on the front faces of the substrates.

12. A process according to claim 10, wherein said coating step comprises wet electroless plating a metal selected from the group of noble metals on the front faces of the substrates.

13. A process according to claim 10, wherein said coating step comprises evaporation of a metal selected from the group of noble metals on the front faces of the substrates.

14. A process according to claim 10, wherein said coating step comprises sputtering a metal selected from the group of noble metals on the front faces of the substrates.

15. A process according to claim 10, wherein said coating step comprises ion plating a metal selected from the group of noble metals on the front faces of the substrates.

16. A process according to claim 10, wherein said coating step comprises chemical vapor deposition of a metal selected from the group of noble metals on the front faces of the substrates.

17. A process according to claim 10, wherein said coating step comprises plasma chemical vapor deposition of a metal selected from the group of noble metals on the front faces of the substrates.

18. A process according to claim 10, wherein said coating step comprises depositing a metal having a thickness of about 0.5 to 12 micrometers on the front faces.

19. A process according to claim 10, wherein said coating step comprises depositing a metal having a thickness of about 3 to 6 micrometers on the front faces.

20. A process according to claim 10, further comprising the step of selecting a metal from the group of noble metals as the ink repellent layer.

21. A process according to claim 10, wherein said coating step occurs prior to coupling the first substrate to the second substrate.

22. A thermal ink jet printhead, comprising:

a first substrate defining a channel plate having a first front face;

a second substrate defining an actuator plate having a second front face, said first front face and said second front face defining a printhead front face, said first substrate and said second substrate disposed in a facing relationship defining ink channels therebetween and nozzles in said printhead front face;

an outer, metallic, ink repellant layer coated on said printhead front face adjacent said nozzles; and an adhesion layer on said printhead front face beneath said outer layer, wherein said adhesion layer comprises an element selected from the group consisting of chromium, nickel, titanium, tantalum, aluminum, and tungsten.

23. A process for ensuring directionality of ink droplets ejected from an ink jet printhead, comprising the steps of:

forming the ink jet printhead by coupling a first substrate having channels therein and a first front face to a second substrate having a second front face, the first front face and the second front face being coextensive and defining a printhead front face having nozzles therein;

depositing a conductive layer on the printhead front face; and electroplating a metal selected from the group of noble metals on the printhead front face around said nozzles.

24. A process for ensuring directionality of ink droplets ejected from an ink jet printhead, comprising the steps of:

coating a metallic, ink repellant layer on a front face of a first substrate having channels therein;

coating a metallic, ink repellant layer on a second front face of a second substrate; and forming the ink jet printhead by coupling the first substrate to the second substrate, the first substrate and the second substrate being coextensive and defining nozzles therein.

* * * * *